US006004171A

United States Patent [19]

Ito et al.

[11] Patent Number: 6,004,171

[45] Date of Patent: Dec. 21, 1999

[54] CRIMP-TYPE TERMINAL

[75] Inventors: Naoki Ito, Shizuoka; Tetsuo Jibe, deceased, late of Aichi, both of Japan, by Kimiji Jibe, Fumiko Jibe, legal representatives

[73] Assignee: Yazaki Corporation, Tokyo, Japan

[21] Appl. No.: 09/035,980

[22] Filed: Mar. 6, 1998

[30] Foreign Application Priority Data

Mar. 7, 1997 [JP] Japan ..... 9-053234

[51] Int. Cl.[6] ..... H01R 4/10

[52] U.S. Cl. ..... 439/877; 439/882

[58] Field of Search ..... 439/877, 878, 439/879, 880, 881, 748, 882

[56] References Cited

U.S. PATENT DOCUMENTS 3,032,602 5/1962 Farnell ..... 439/877
3,051,773 8/1962 Batcheller ..... 439/878
3,990,143 11/1976 Dittman et al. ..... 29/628
4,815,200 3/1989 Ito ..... 439/884
5,599,214 2/1997 Sakai et al. ..... 439/877

*Primary Examiner*—Lincoln Donovan
*Attorney, Agent, or Firm*—Sughrue, Mion, Zinn, Macpeak & Seas, PLLC

[57] ABSTRACT

A crimp-type terminal for electrically connecting an internal conductor to a mating terminal, includes: an electrical connection portion for fitting connection to the mating terminal; a conductor clamping portion having a base plate, and upstanding walls which extend respectively from opposite side edges of the base plate, and are pressed to clamp the internal conductor; and interconnecting walls respectively connecting the upstanding walls to the electrical connection portion, wherein each of the interconnecting walls have a bend portion for absorbing a stress, produced in a direction of a width of the crimp-type terminal when the interconnecting walls are pressed, by deformation.

6 Claims, 7 Drawing Sheets

CRIMP-TYPE TERMINAL

BACKGROUND OF INVENTION

This invention relates to a crimp-type terminal in which a strain is prevented from developing in the crimp-type terminal when clamping a conductor of a wire to a conductor connection portion of the crimp-type terminal, thereby preventing the strength of the crimp-type terminal from being reduced.

FIG. 8 is a perspective view showing a general crimp-type female terminal T, and an electrical connection portion 2 is provided at one end of a base plate 1, and a wire connection portion 3, having a sheath clamping portion 4 and a conductor clamping portion 5, is provided at the other end of the base plate 1.

The electrical connection portion 2 includes side walls 2*a* extending perpendicularly respectively from opposite side edges of the base plate 1, and upper walls 2*b* extending respectively from the side walls 2*a*, and the electrical connection portion 2 has a box-shape having opposite open ends. A tongue (not shown) for resiliently contacting a male terminal is provided within this electrical connection portion 2.

The sheath clamping portion 4 includes holding piece portions 6 extending respectively from the opposite side edges of the base plate 1 in an upstanding manner, and after a sheath 7 of a sheathed wire W is inserted into a space between the two holding piece portions 6, the two holding piece portions 6 are bent inwardly to hold the sheath 7 therebetween.

The conductor clamping portion 5 includes upstanding walls 8 extending respectively from the opposite side edges of the base plate 1 in an upstanding manner, and the upstanding walls 8 are pressed to clamp an exposed conductor 9 at one end of the sheathed wire W.

Interconnecting walls 10, which reinforce the crimp-type terminal T, are formed between the conductor clamping portion 5 and the electrical connection portion 2.

In order to meet the requirement that the crimp-type terminal T should have a small-size design, there has been a tendency to reduce the distance between the conductor clamping portion 5 and the electrical connection portion 2, and when this distance is reduced, the interconnecting walls 10 can not be easily bent or deformed, and stresses, developing when pressing the conductor clamping portion 5, are not absorbed by the short interconnecting walls 10, which results in a problem that at least one of the conductor clamping portion 5 and the electrical connection portion 2 is deformed.

For example, as shown in FIG. 9, in the crimp-type terminal T in which a width B of the pressed conductor clamping portion 5 is smaller than a width A' of the electrical connection portion 2, the rigidity of the electrical connection portion 2 provides forces $F_1$ which tend to prevent the clamping deformation of the conductor clamping portion 5 through the short interconnecting walls 10.

Therefore, the distal ends of the two upstanding walls 8 are spaced apart from each other at that portion of the pressed conductor clamping portion 5 disposed near to the electrical connection portion 2, thus forming a gap $C_1$, and as a result there are encountered disadvantages that the clamping force of the conductor clamping portion 5 is inadequate, and that an electrical resistance is increased (see FIG. 9, and FIG. 10, which is a cross-sectional view taken along the line X—X of FIG. 9).

In contrast, in the crimp-type terminal T in which the width B of the pressed conductor clamping portion 5 is larger than the width A' of the electrical connection portion 2, the rigidity of the pressed conductor clamping portion 5 provides forces $F_2$ which tend to increase the width of the electrical connection portion 2 through the short interconnecting walls 10.

Where the upper walls 2*b* of the electrical connection portion 2 are defined respectively by upper portions 2*c* of the bent side walls 2*a* butted together, a gap $C_2$ develops between the butted edges of the upper portions 2*c* (FIG. 11).

In order to eliminate mutually-interfering forces between the electrical connection portion 2 and the conductor clamping portion 5 while keeping the distance between the electrical connection portion 2 and the conductor clamping portion 5 small, there is proposed a method of providing a slit 11 in the interconnecting wall 10 (see FIG. 12).

If the slit 11 is deep enough to be close to the base plate 1, those portions of the interconnecting wall 10, disposed respectively on the opposite sides of the slit 11, can be flexed or bent independently of each other without mutual interference, and therefore the above-mentioned disadvantages are overcome. However, this portion creates a weak point for a bending moment, and there is encountered a problem that the overall strength of the crimp-type terminal T against the bending is extremely reduced.

The present invention seeks to overcome the above problems, and an object of the invention is to provide a crimp-type terminal in which mutually-interfering forces, developing between the conductor clamping portion 5 and the electrical connection portion 2 when pressing the conductor clamping portion 5, are substantially eliminated.

SUMMARY OF INVENTION

To acheve these objects, the present invention provides a crimp-type terminal for electrically connecting an internal conductor to a mating terminal, comprising: an electrical connection portion for fitting connection to the mating terminal; a conductor clamping portion having a base plate, and upstanding walls which extend respectively from opposite side edges of the base plate, and are pressed to clamp the internal conductor; and interconnecting walls respectively connecting the upstanding walls to the electrical connection portion, wherein each of the interconnecting walls have a bend portion for absorbing a stress, produced in a direction of a width of the crimp-type terminal when the interconnecting walls are pressed, by deformation.

Preferably, each of the interconnecting walls extends substantially linearly from the bend portion, provided intermediate opposite ends of the interconnecting wall, to the electrical connection portion, and also extends substantially linearly from the bend portion to the associated upstanding wall.

Preferably, the crimp-type terminal further comprises a neck formed at part of the interconnecting walls disposed in close proximity to the upstanding walls, such that the distance between the interconnecting walls is the smallest at the necks, and wherein the following expression is satisfied:

$$A+t \geqq B \geqq A-t,$$

where a distance between the interconnecting walls at the necks is represented by A, a width of the conductor clamping portion is represented by B, and a thickness of each of the interconnecting walls is represented by t. More preferably, A=B.

DETAILED DESCRIPTION OF PREFERRED EMBODIMENTS

Figure 1:
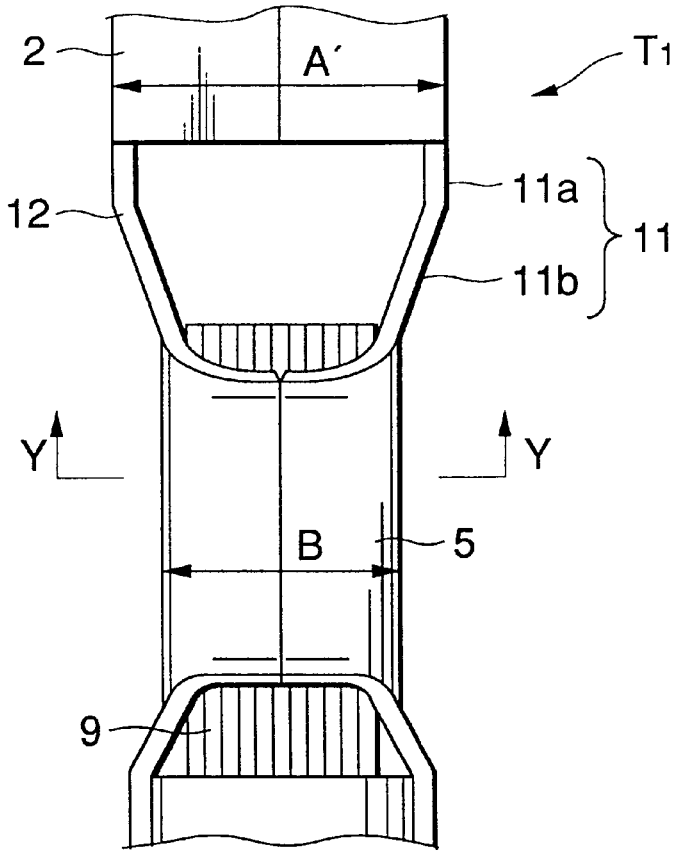
FIG. 1 is a plan view of a portion of a crimp-type terminal in which a width of an electrical connection portion is larger than a width of a conductor clamping portion, showing the shape of bend portions.
Figure 3:
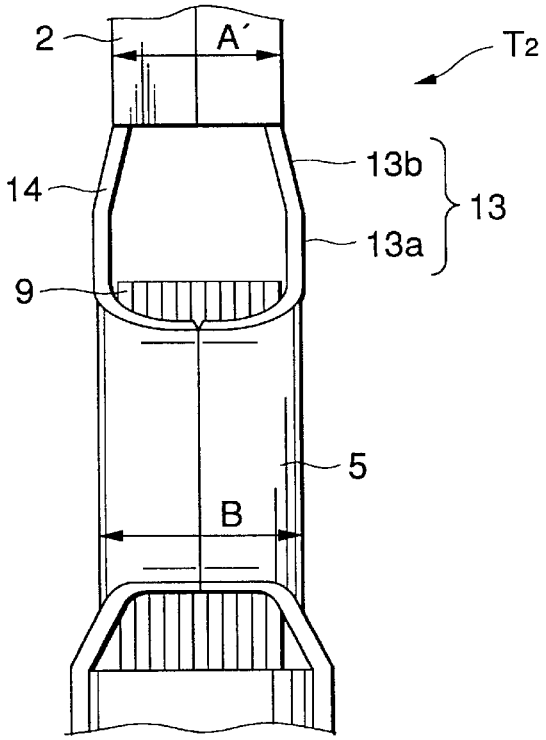
FIG. 3 is a plan view of a portion of a crimp-type terminal in which a width of a conductor clamping portion is larger than a width of an electrical connection portion, showing the shape of bend portions.

A preferred embodiment of the present invention will now be described with reference to the drawings. FIGS. 1 and 3 are plan views of a portion of crimp-type terminals of the invention, showing a bend portion.

As shown in FIG. 1, in the crimp-type terminal $T_1$ in which a width A' of an electrical connection portion 2 is larger than a width B of a pressed conductor clamping portion 5, the bend portion 12 is provided at each of two interconnecting walls 11 intermediate opposite ends thereof, and the distance between interconnecting wall portions 11*a* each extending from the associated bend portion 12 to the electrical connection portion 2 is substantially equal to the width A' of the electrical connection portion 2, and the distance between interconnecting wall portions 11*b* each extending from the associated bend portion 12 to the conductor clamping portion 5 is linearly decreasing progressively from the width A' to the width B.

Each interconnecting wall 11 can be easily bent and deformed about the bend portion 12, and therefore a force, developing when pressing the conductor clamping portion 5, is absorbed by the deformation of the interconnecting wall portion 11*b*, and is hardly transmitted to the interconnecting wall portion 11*a*.

The rigidity of the electrical connection portion 2 is transmitted to the interconnecting wall portions 11*a*, but is hardly transmitted to the interconnecting wall portions 11*b*.

Figure 2:
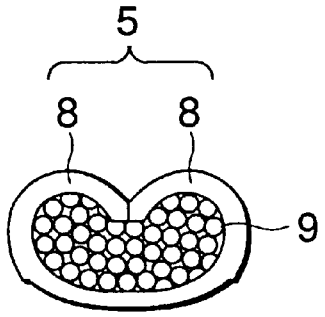
FIG. 2 is a cross-sectional view taken along the line Y—Y of FIG. 1.
Figure 10:
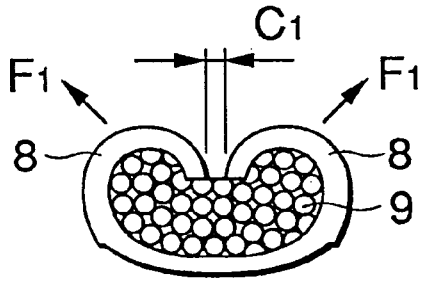
FIG.10 PRIOR ART
FIG. 10 is a cross-sectional view taken along the line X—X of FIG. 9.

Therefore, the conductor clamping portion 5 undergoes a pressing (clamping) force in such a manner that this portion 5 is hardly influenced by the rigidity of the electrical connection portion 2, and therefore the conductor clamping portion 5 can clamp a conductor 9 without forming a gap such as the gap $C_1$ of FIG. 10, and maintains a good electrically-connected condition (see FIG. 2 which is a cross-sectional view taken along the line Y—Y of FIG. 1).

As shown in FIG. 3, in the crimp-type terminal $T_2$ in which a width B of a pressed conductor clamping portion 5 is larger than a width A' of an electrical connection portion 2, the distance between interconnecting wall portions 13*a* each extending from an associated bend portion 14 (provided at an interconnecting wall 13 intermediate opposite ends thereof) to the conductor clamping portion 5 is substantially equal to the width B of the conductor clamping portion 5, and the distance between interconnecting wall portions 13*b* each extending from the associated bend portion 14 to the electrical connection portion 2 is linearly decreasing progressively to the width A' of the electrical connection portion 2.

In this case, also, each interconnecting wall 13 can be easily bent and deformed about the bend portion 14, and therefore a force, developing when pressing the conductor clamping portion 5, and the rigidity of the electrical connection portion 2, are absorbed by the deformation of the interconnecting wall portions 13*a* and 13*b* about the bend portion 14.

Figure 11:
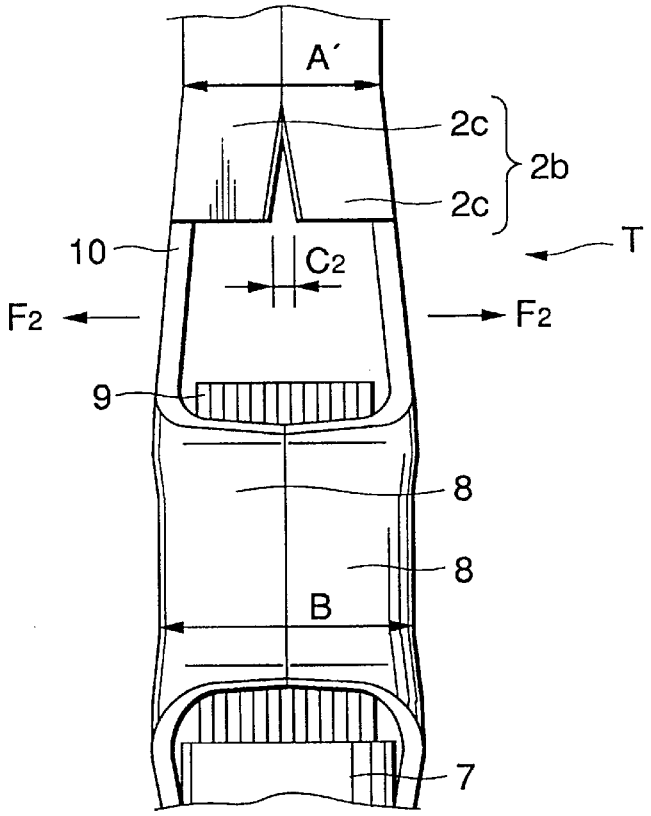
FIG.11 PRIOR ART
FIG. 11 is a view explanatory of a problem with a conventional terminal in which a width of a conductor clamping portion is larger than a width of an electrical connection portion.
Figure 12:
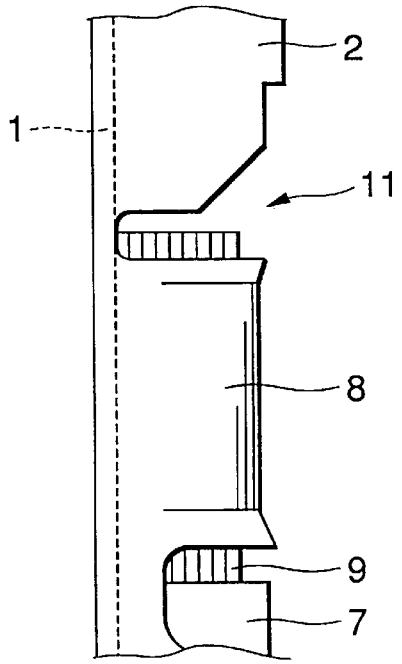
FIG.12 PRIOR ART
FIG. 12 is a view showing a slit formed between the electrical connection portion and the conductor clamping portion.

Therefore, a gap, such as the gap $C_2$ of FIG. 11, will not be formed in the electrical connection portion 2.

Figure 4:
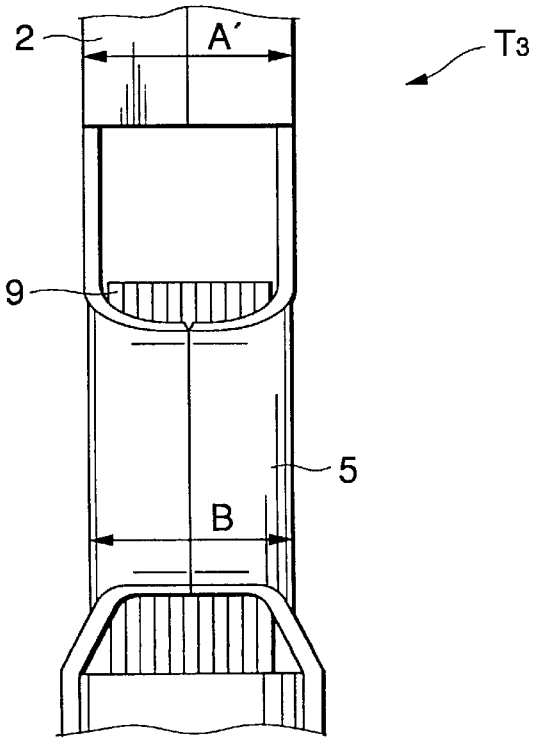
FIG. 4 is a plan view of a portion of a crimp-type terminal in which a width of a conductor clamping portion is substantially equal to a width of an electrical connection portion.

As shown in FIG. 4, in a crimp-type terminal $T_3$ in which a width A' of an electrical connection portion 2 is substantially equal to a width B of a conductor clamping portion 5, when pressing the conductor clamping portion 5, any interfering force, tending to spread the opposite portion, does not develop in the electrical connection portion 2 and the conductor clamping portion 5, and therefore it may not be necessary to provide the bend portions 12, 14. However, if the width A' and the width B are not equal to each other although the difference is small, the bend portions 12, 14 can be provided.

Figure 5:
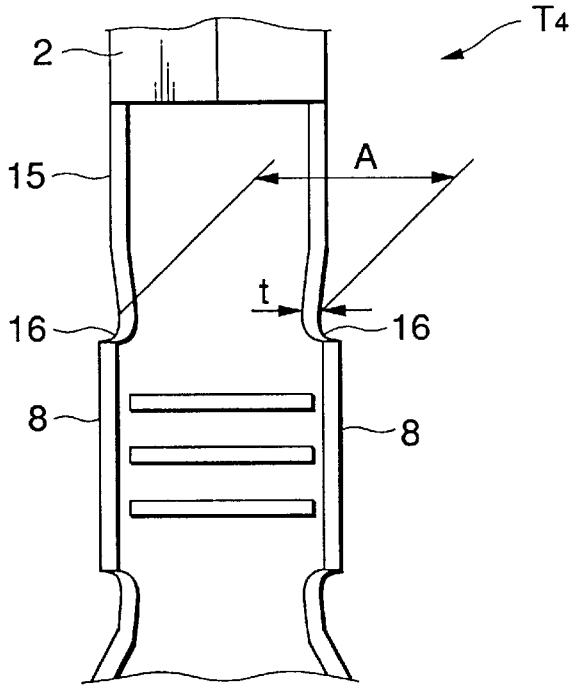
FIG. 5 is a plan view of a portion of a crimp-type terminal in which a neck is provided at each interconnecting wall.
Figure 6:
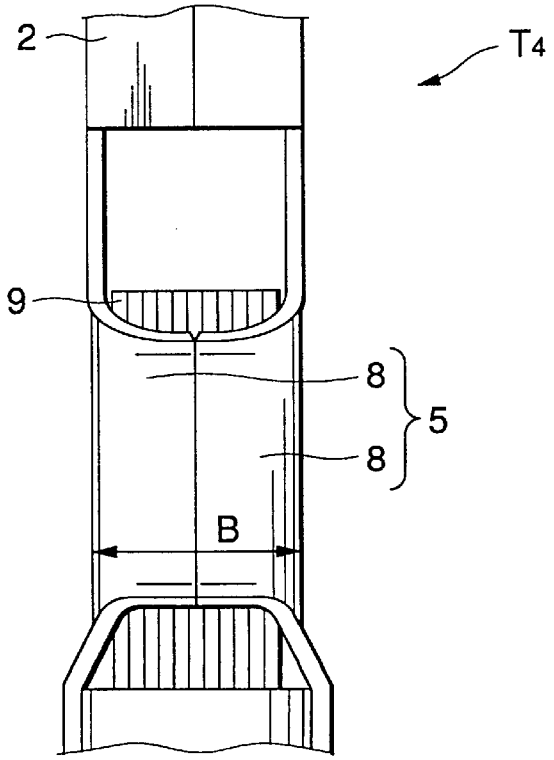
FIG. 6 is a plan view of a portion of a crimp-type terminal in which the distance between necks is equal to a width of a conductor clamping portion.

As shown in FIG. 5, in a crimp-type terminal $T_4$, a neck 16 is formed at that portion of each interconnecting wall 15 disposed in close proximity to an upstanding wall 8, so that the distance between the two interconnecting walls 15 is the smallest at the necks 16, and if the distance between the two interconnecting walls 15 at the necks 16 is represented by A, and the thickness of each interconnecting wall 15 is represented by t, a width B of a conductor clamping portion 5 is in the range of $A \pm t = B$ (preferably, $A = B$). In this crimp-type terminal, gaps, such as the gaps $C_1$ and $C_2$ in the conventional terminals, will not be formed (see FIG. 6).

Even in the range of $A \pm t = B$, the bend portions 12, 14 may be used.

Figure 7:
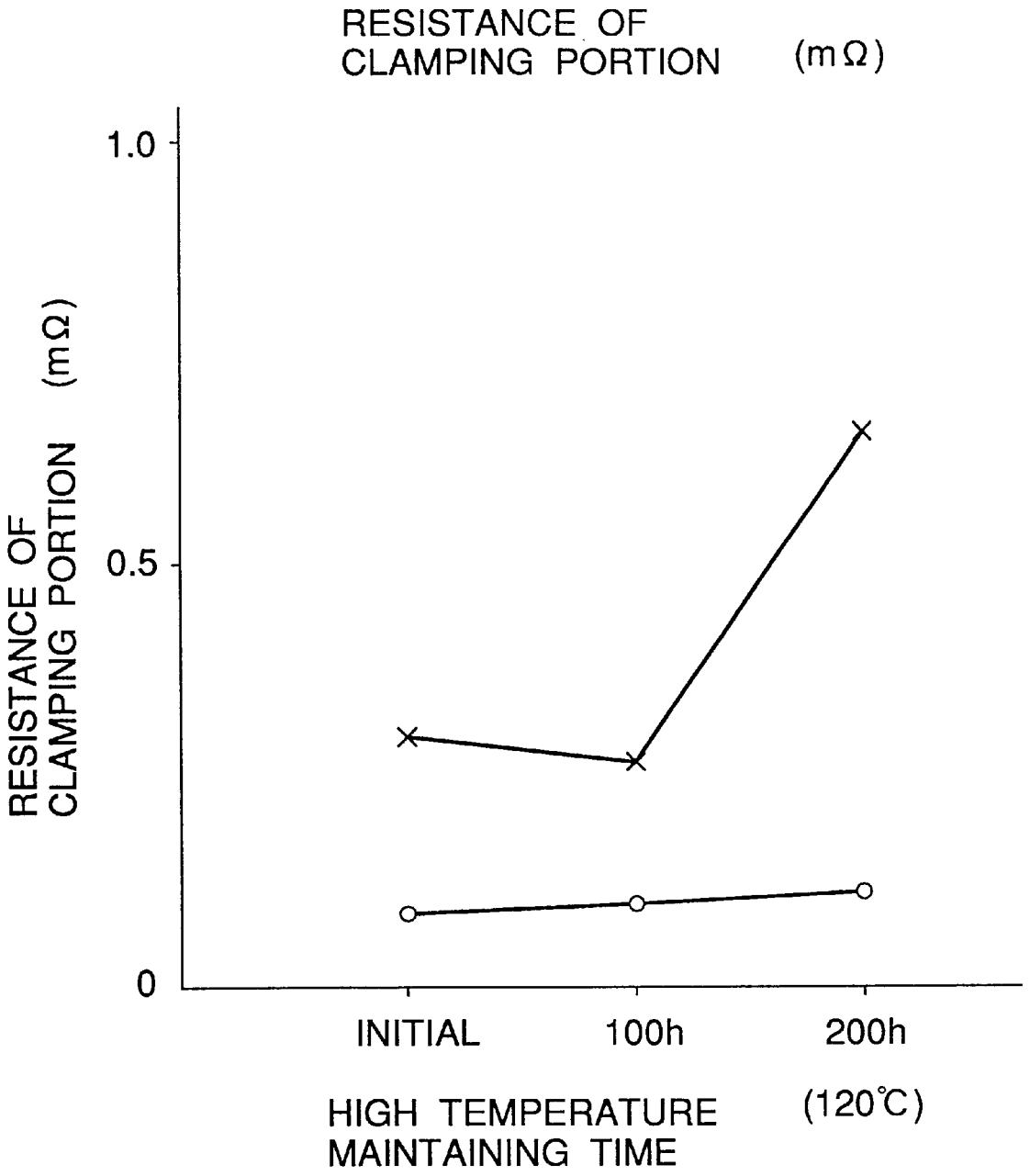
FIG. 7 is a graph comparing an electrical resistance value of the crimp-type terminal of the embodiment according to the invention with that of a conventional crimp-type terminal.
Figure 8:
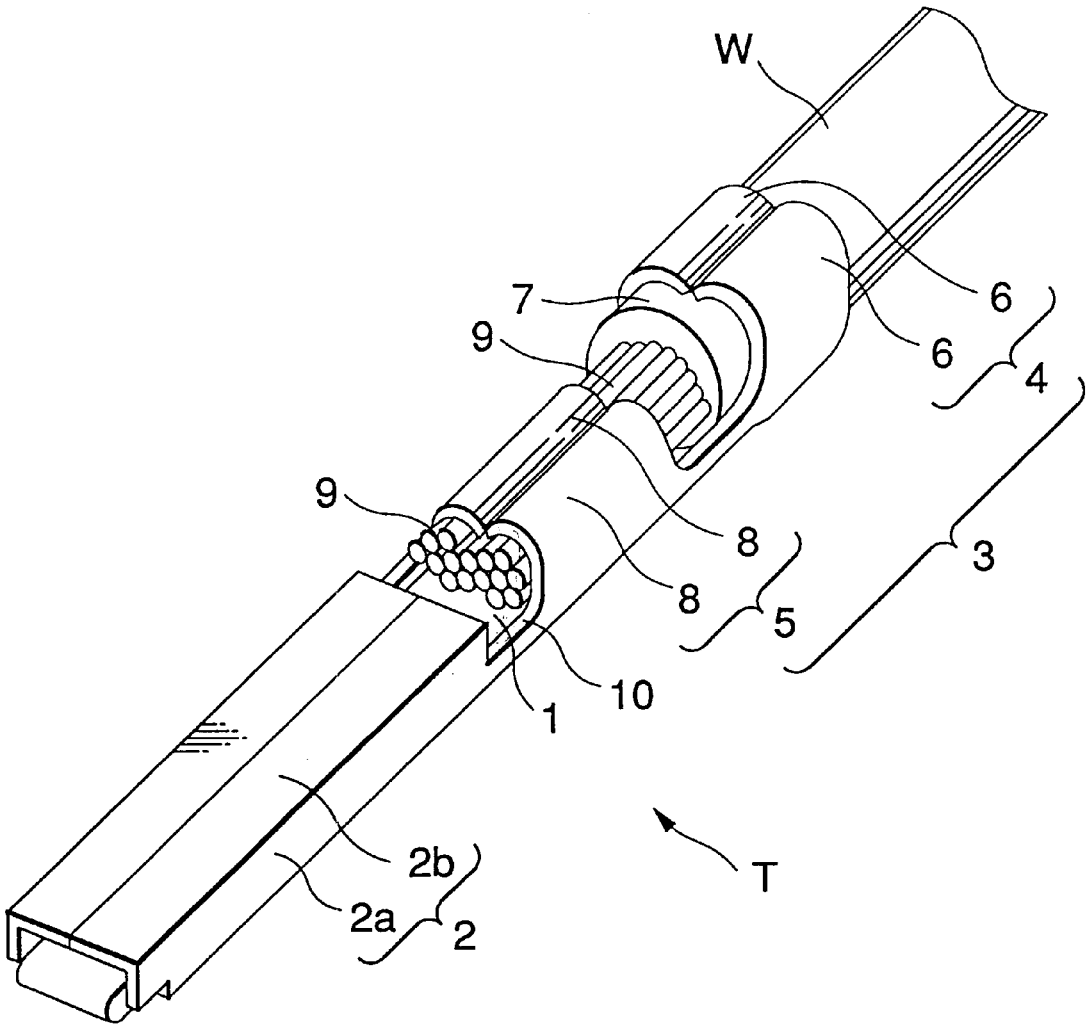
FIG.8 PRIOR ART
FIG. 8 is a perspective view of a general crimp-type female terminal.
Figure 9:
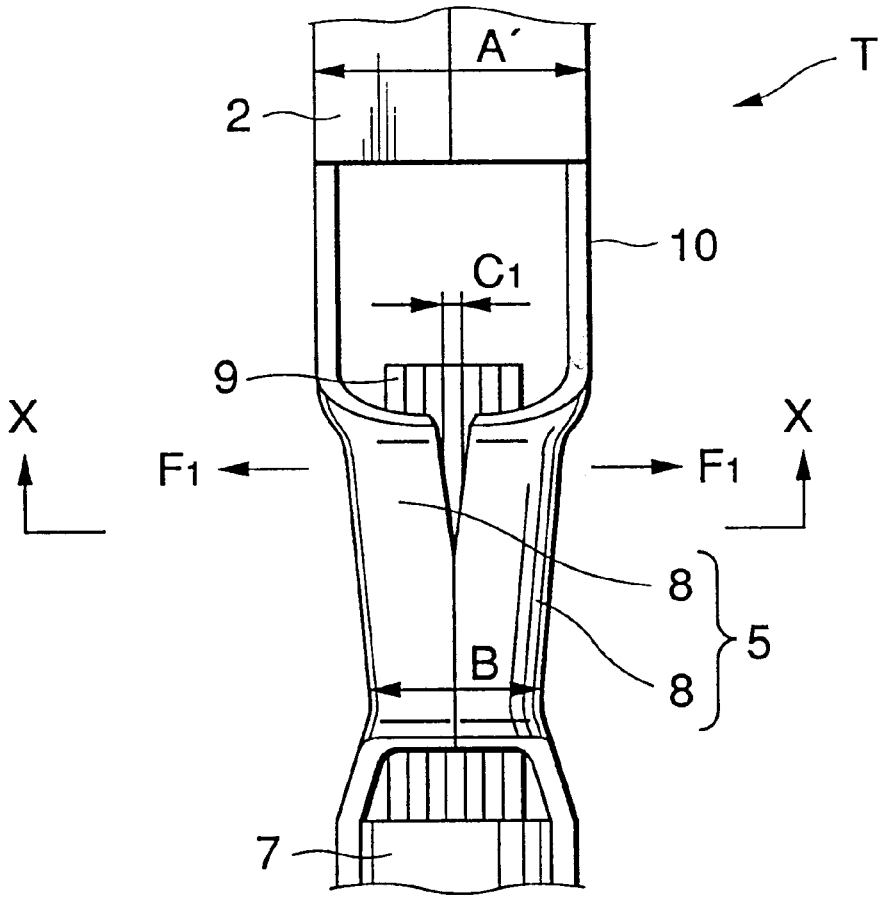
FIG.9 PRIOR ART
FIG. 9 is a view explanatory of a problem with the conventional terminal in which a width of an electrical connection portion is larger than a width of a conductor clamping portion.

Resistances in the clamping portions of the crimp-type terminal $T_4$ (in which the distance A between the interconnecting walls 15 at the necks 16 is equal to the width B of the conductor clamping portion) and the crimp-type terminal T of FIG. 9 were measured, and test results, shown in FIG. 7, were obtained.

In FIG. 7, the ordinate axis represents the electrical resistance value of the conductor clamping portion, and the abscissa axis represents a high-temperature maintaining time. Mark o represents the resistance value of the crimp-type terminal $T_4$, and mark x represents the resistance value of the crimp-type terminal T.

As will be appreciated from FIG. 7, the resistance value of the crimp-type terminal $T_4$ is much lower than that of the crimp-type terminal T, and does not increase so much even when it is maintained at high temperatures for a long time.

With the above construction of the present invention, the following advantageous effects are achieved.

(1) When the distance between the electrical connection portion and the conductor clamping portion is reduced, the mutually-interfering forces are produced because of the difference in width between the electrical connection portion and the conductor clamping portion, and as a result there has been encountered the problem that a gap is formed in one of the electrical connection portion and the conductor clamping portion. However, this problem is overcome by providing the bend portion at each of the interconnecting walls.

(2) The neck is formed at that portion of each interconnecting wall disposed in close proximity to the upstanding wall, so that the distance between the two interconnecting walls is the smallest at the necks, and if the distance between the two interconnecting walls at the necks is represented by A, and the thickness of each interconnecting wall is represented by t, the width B of the conductor clamping portion is in the range of $A \pm t = B$, namely $A+t \geqq B \geqq A-t$, and with this construction, the above gap problem can be overcome.

Particularly, the relation, A=B, is preferred.

What is claimed is:

1. A crimp-type terminal for electrically connecting an exposed conductor to a mating terminal, comprising:

an electrical connection portion for fitting connection to said mating terminal;

a conductor clamping portion having a base plate, upstanding walls which extend respectively from opposite side edges of said base plate configured to receive said exposed conductor; and first interconnecting walls and second interconnecting walls defining a bend portion therebetween, wherein said first interconnecting walls are connected to said upstanding walls on one side and are connected to said second interconnecting walls at said bend portion on another side, wherein said second interconnecting walls are connected to said first connecting walls at said bend portion on one side and to said electrical connecting portion on another side, and wherein said bend portion and at least one of said first interconnecting walls and said second interconnecting walls is capable of substantially absorbing a stress developed in at least one of said electrical connection portion and said conductor clamping portion.

2. A crimp-type terminal according to claim 1, wherein said second interconnecting walls extend substantially linearly from said bend portion to said electrical connection portion and said first interconnecting walls extend substantially linearly from said bend portion to an associated said upstanding wall.

3. A crimp-type terminal according to claim 1, further comprising:

a neck formed at part of said first interconnecting walls disposed in close proximity to said upstanding walls, such that a distance between said first interconnecting walls measured across said base is the smallest at said neck, and wherein the following expression is satisfied:

$$A+t \geqq B \geqq A-t,$$

where a distance between said first interconnecting walls at said neck is represented by A, a width of said conductor clamping portion is represented by B, and a thickness of each of said first interconnecting walls is represented by t.

4. The crimp-type terminal according to claim 3, wherein A=B.

5. A crimp-type terminal for electrically connecting an exposed conductor to a mating terminal, comprising:

an electrical connection portion for fitting connection to said mating terminal;

a conductor clamping portion having a base plate, upstanding walls which extend respectively from opposite side edges of said base plate configured to receive said exposed conductor;

first interconnecting walls and second interconnecting walls defining a bend portion therebetween, wherein said first interconnecting walls are connected to said upstanding walls on one side and are connected to said second interconnecting walls at said bend portion on another side, wherein said second interconnecting walls are connected to said first connecting walls at said bend portion on one side and to said electrical connecting portion on another side, wherein a width of said electrical connecting portion is less than a width of said conductor clamping portion, and wherein said bend portion and at least one of said first interconnecting walls and said second interconnecting walls is capable of substantially absorbing a stress developed in at least one of said electrical connection portion and said conductor clamping portion.

6. A method for electrically connecting an exposed internal conductor to a mating terminal, utilizing the apparatus of claim 5, and comprising the steps of:

pressing said upstanding walls inwardly so as to deform said upstanding walls; and deflecting said upstanding walls until a top portion of one of said upstanding walls is pressed against a top portion of another of said upstanding walls along a length thereof.

* * * * *